US005367874A

United States Patent [19]

Auffret et al.

[11] Patent Number: 5,367,874

[45] Date of Patent: Nov. 29, 1994

[54] INTEGRAL COMPOSITE GAS TURBINE AFTERBURNER STRUCTURE

[75] Inventors: Didier L. C. Auffret, Combs La Ville; Gérard C. L. Berger, Quincy S/Senart; Eric Conete, Le Mee S/Seine; Frédéric Delage, Paris; Gérard E. A. Jourdain, Saintry Sur Seine; Christophe J. F. Thorel, Paris, all of France

[73] Assignee: Societe Nationale D'Etude et de Construction de Moteurs D'Aviation (S.N.E.C.M.A.), Paris, France

[21] Appl. No.: 162,879

[22] Filed: Dec. 8, 1993

[30] Foreign Application Priority Data

Dec. 16, 1992 [FR] France ..... 9215120

[51] Int. Cl.[5] ..... F02K 3/10

[52] U.S. Cl. ..... 60/261; 60/740; 60/749

[58] Field of Search ..... 60/740, 749, 753, 261

[56] References Cited

U.S. PATENT DOCUMENTS

| | | | |
|---|---|---|---|
| 3,170,294 | 2/1965 | Meyer et al. . | |
| 3,176,465 | 4/1965 | Colley | 60/749 |
| 3,595,024 | 7/1971 | Kohler . | |
| 4,185,458 | 1/1980 | Ernst | 60/261 |
| 4,380,899 | 4/1983 | Davies et al. . | |
| 4,716,640 | 1/1988 | Jourdain et al. . | |

FOREIGN PATENT DOCUMENTS

| | | | |
|---|---|---|---|
| 1050770 | 3/1979 | Canada | 60/261 |
| 1132384 | 6/1962 | Germany | 60/261 |

*Primary Examiner*—Richard A. Bertsch
*Assistant Examiner*—William J. Wicker
*Attorney, Agent, or Firm*—Bacon & Thomas

[57] ABSTRACT

An integral, one-piece afterburner structure for a turbojet engine is disclosed which is formed of composite material. The afterburner structure has an outer casing formed as a body of revolution about a central axis, an inner casing also formed as a body of revolution about the central axis, which casings are integrally joined by a plurality of connecting arms extending between the inner and outer casing. The connecting arms are also formed of a composite material and are integrally molded with both the inner and outer casings. The afterburner structure also has a plurality of secondary support arms formed of composite material which extend either from the outer, or the inner casing in a generally radial direction relative to the central axis. Integrally formed with the plurality of secondary support arms is at least one annular flameholder ring which extends around the central axis and is supported by the secondary support arms.

8 Claims, 4 Drawing Sheets

INTEGRAL COMPOSITE GAS TURBINE AFTERBURNER STRUCTURE

BACKGROUND OF THE INVENTION

The present invention relates to an afterburner structure for a gas turbine engine, such as a turbojet engine, wherein the afterburner structure is integrally molded from a composite material.

Afterburner assemblies for turbojet engines are well-known in the art and typically comprise many individual components manufactured independently from one another and then mechanically assembled to form the afterburner structure. Such known afterburner assemblies require many parts affixing means which interfere with the gas flow through the afterburner, thereby degrading the overall efficiency of the turbojet engine.

The known afterburner assemblies are also undesirably heavy thereby increasing the overall weight of the turbojet engine and consequently reducing the payload capacities of the aircraft with which the engine is associated.

SUMMARY OF THE INVENTION

An integral, one-piece afterburner structure for a turbojet engine is disclosed which is formed of composite material. The afterburner structure has an outer casing formed as a body of revolution about a central axis, an inner casing also formed as a body of revolution about the central axis, which casings are integrally joined by a plurality of connecting arms extending between the inner and outer casing. The connecting arms are also formed of a composite material and are integrally molded with both the inner and outer casings.

The afterburner structure also has a plurality of secondary support arms formed of composite material which extend either from the outer, or the inner casing in a generally radial direction relative to the central axis. Integrally formed with the plurality of secondary support arms is at least one annular flameholder ring which extends around the central axis and is supported by the secondary support arms.

At least one of the connecting arms defines a main fuel conduit and a plurality of fuel injecting holes communicating with the main fuel conduit to inject fuel into the gas flow passing through the afterburner structure. Similarly, the annular flameholder ring defines a conduit in fluid communication with the main fuel conduit as well as a plurality of secondary fuel injecting holes to enable fuel to be injected into the gas flow stream through the annular flameholder ring.

According to the invention, these elements are all formed of composite material as an integral unit. The use of composite materials enables the weight of the afterburner structure to be reduced compared to the known afterburner structures and eliminates the need for any mechanical affixing means which may interfere with the gas flow through the afterburner structure. The integral afterburner structure may be molded using two distinct types of composite materials, the first composite being used for the outer casing and a second composite used for the inner casing wherein the second composite material is able to withstand the higher temperatures of the inner portion of the afterburner than the first composite material.

It is also possible to form the connecting arms, as well as the secondary support arms with conduits which may constitute at least some of the main fuel conduits to supply fuel to the afterburner. The connecting arms and support arms may also be easily formed in "V" or "U"-shaped cross-sectional configurations to facilitate the fuel mixing with the gas flow passing through the afterburner and to minimize any disruption in the gas flow. The connecting and support arms may also extend in a substantially radial plane relative to the central axis.

The primary advantage of the afterburners constructed according to the present invention lies in their weight as well as the cross-sectional configurations of the elements which, in combination with the excellent thermal strength of the composite materials and high temperatures, allows the increase in efficiency of the gas turbine engines to which the afterburner is attached.

DETAILED DESCRIPTION OF THE PREFERRED EMBODIMENT

Figure 1:
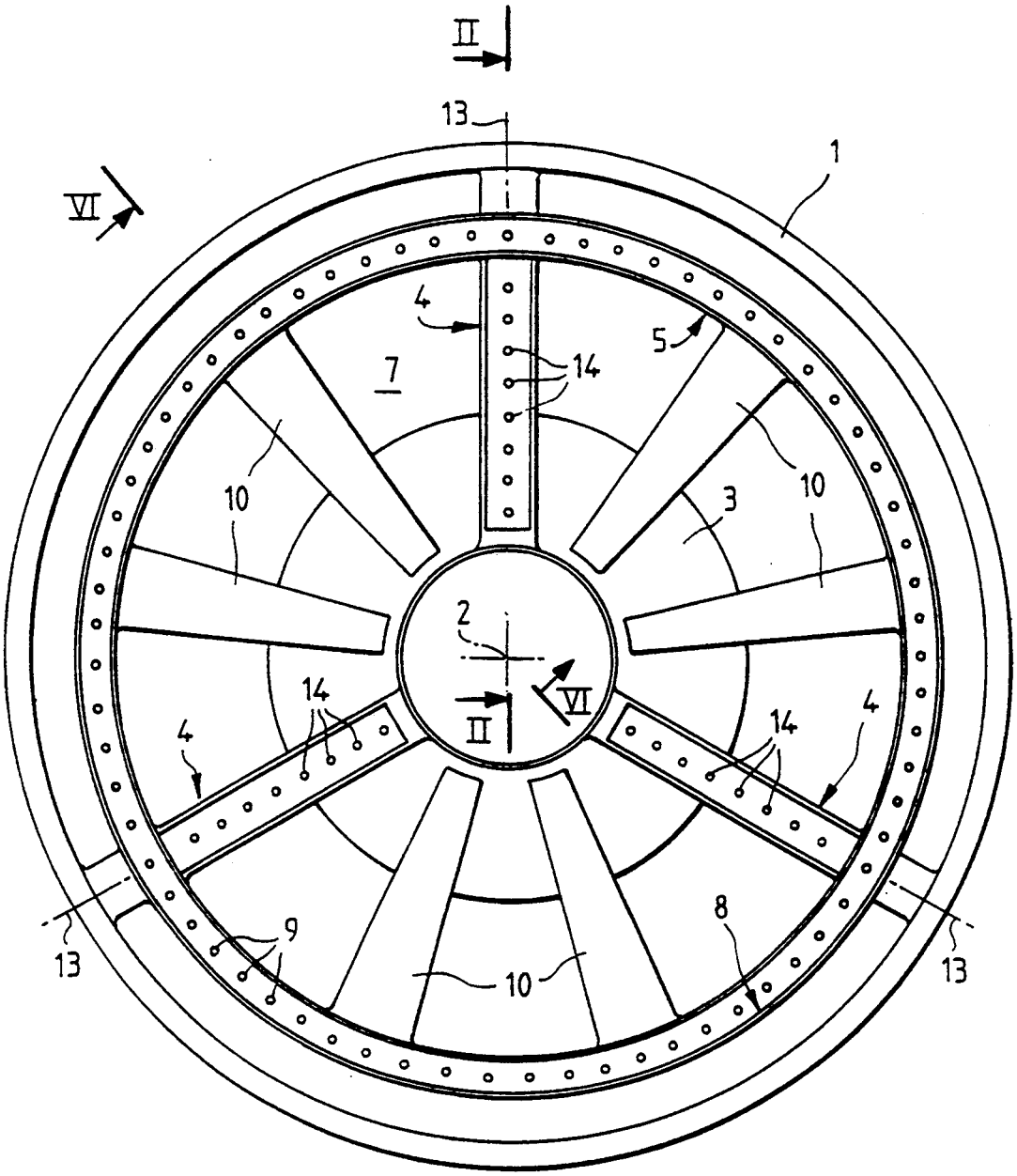
FIG. 1 is a rear view, viewed in the direction of arrow F in FIG. 2, of the integral afterburner according to the present invention.

The afterburner according to the present invention comprises an outer casing 1 formed as a body of revolution about central axis 2, an inner casing 3, also formed as a body of revolution about central axis 2 and a plurality of equidistantly spaced connecting arms 4 which extend radially about the central axis 2 and which interconnect the inner casing 3 and the outer casing 1. As illustrated in FIG. 1, three such connecting arms 4 are disclosed, although it is to be understood that any number of such arms may be utilized without exceeding the scope of this invention.

Figure 2:
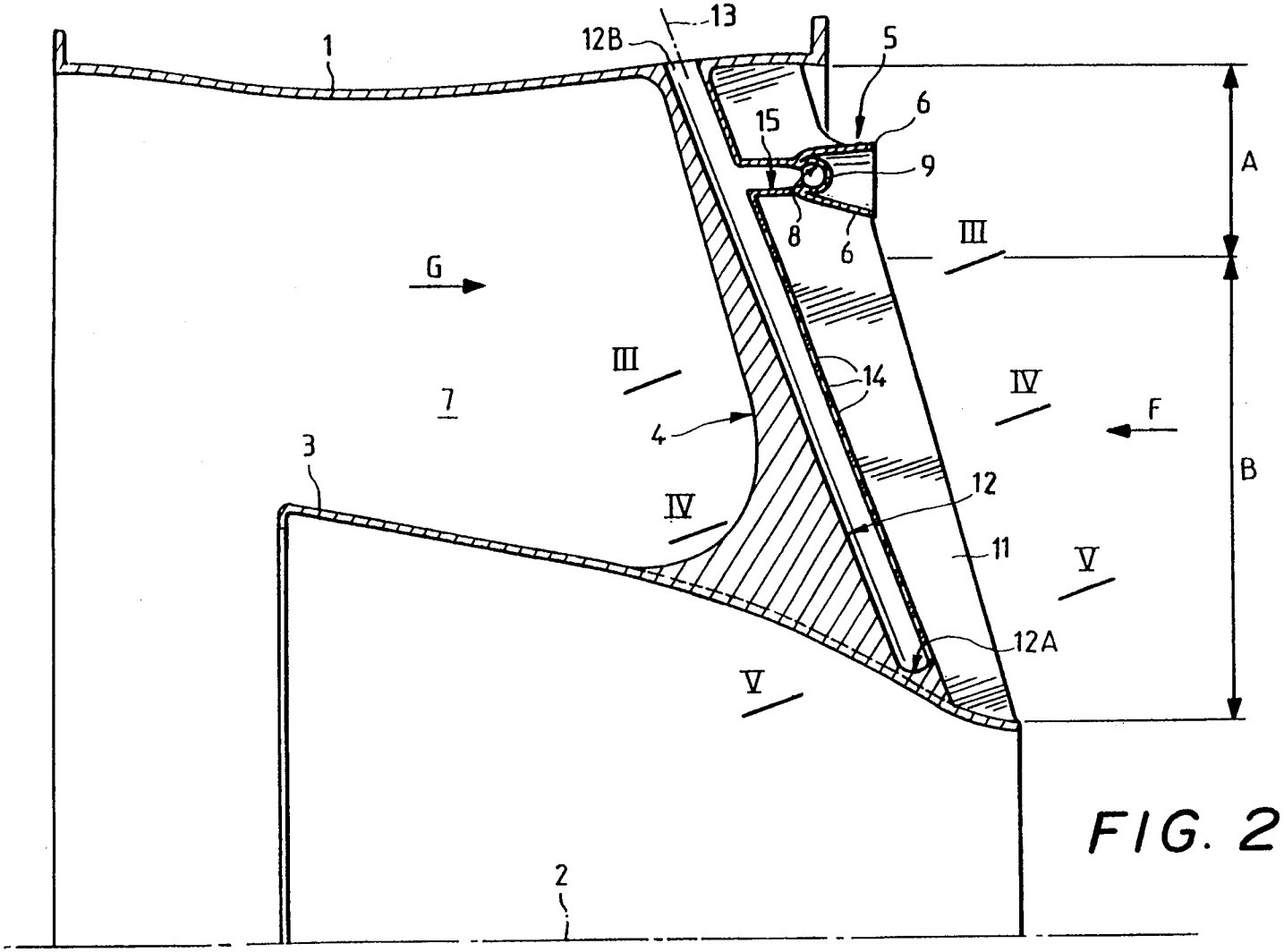
FIG. 2 is a cross-sectional view taken along line II—II in FIG. 1.
Figure 3:
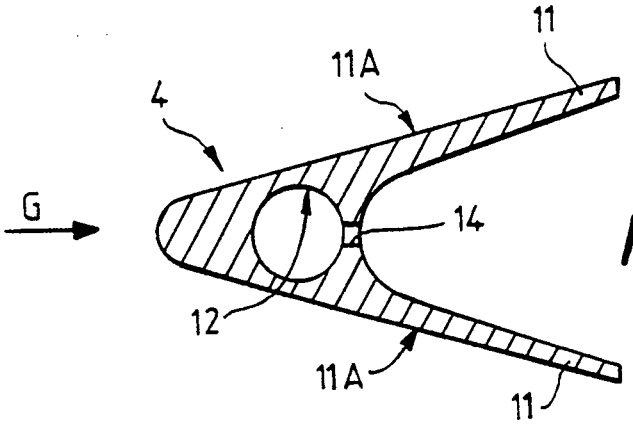
FIGS. 3, 4 and 5 are cross-sections taken along line III—III, IV—IV and V—V, respectively in FIG. 2.
Figure 4:
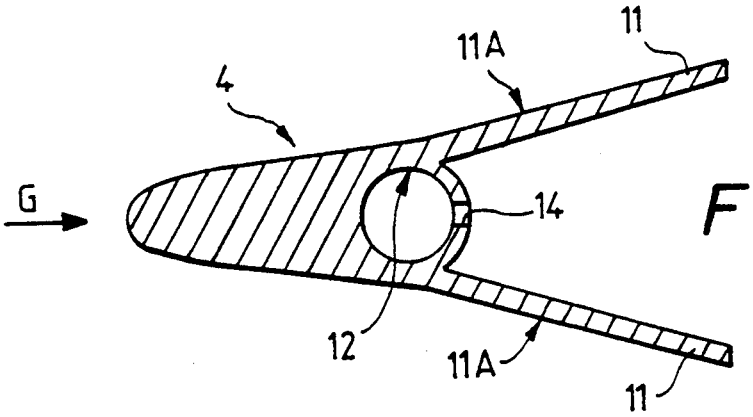
Figure 5:
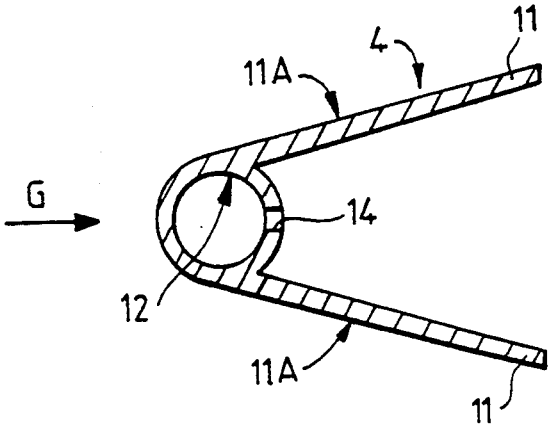
Figure 7:
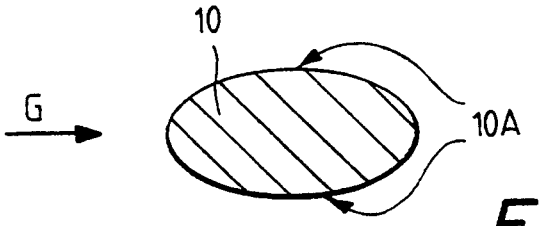
FIG. 7 is a cross-sectional view taken along line VII—VII in FIG. 6.

The structure also includes an annular flameholder ring 5 which extends about central axis 2 and which has a generally "U"-shaped cross-sectional configuration with two legs 6 that extend generally parallel to the central axis 2 such that the flameholder ring 5 opens in a downstream direction, as illustrated in FIG. 2. The gases flowing through the afterburner structure flow in the direction of arrow G from the upstream (towards the left) to the downstream (towards the right) as viewed in FIG. 2. Afterburning chamber 7 is defined between the spaced apart inner and outer casings 3 and 1, respectively.

The afterburner structure also comprises an annular conduit 8 formed integrally with the annular flameholder ring 5 and which is located between the legs 6 of the flameholder ring. The conduit 8 defines a plurality of fuel injecting holes 9 which communicate with the conduit 8 and enable the fuel to be injected through the holes 9 into the gas flow stream.

The flameholder ring 5 is supported on a plurality, in this particular instance six, of secondary support arms 10 which extend generally radially outwardly from the inner casing 3. However, it is to be understood that the secondary support arms 10 could also extend radially inwardly from the outer casing 1 to support the annular flameholder ring 5. The secondary support arms 10 are equidistantly spaced from each other and from the connecting arms 4 so as to connect the flameholder ring 5 to the inner casing 3.

Each of the connecting arms 4 has a substantially "V"-shaped cross-sectional configuration each with two legs 11 opening in a downstream direction. Each connecting arm 4 also may define a radially extending fuel conduit 12 located immediately upstream of the legs 11 such that the fuel conduit 12 has a blind end 12A and an open end 12B which may be connected to an external fuel conduit, schematically illustrated at 13. The support arms 4 also define a plurality of fuel injecting holes 14 which communicate with the main fuel conduit to enable fuel to be injected into the gas flow stream G passing through the afterburner. A conduit 15 connects the main fuel conduit 12 to the annular conduit 8 to enable fuel to also be injected through fuel injecting openings 9.

The shapes of the connecting arms 4 are such that the gas flow flowing in the direction arrow G moves on both sides of the connecting arms 4 along the outsides I 1A of the legs 11 with a minimal pressure loss. Similarly, the support arms 10 are also cross-sectionally configured to minimize pressure losses in the gas flow over the external sides 10A of the secondary support arms.

The afterburner structure is formed of composite material as an integral, one-piece unit. The outer casing 1, the inner casing 3, the connecting arms 4 (as well as their conduits 12), the secondary support arms 10, the flameholder ring 5 (as well as annular conduit 8) and the conduits 15 are molded into a single, one-piece unit.

Figure 6:
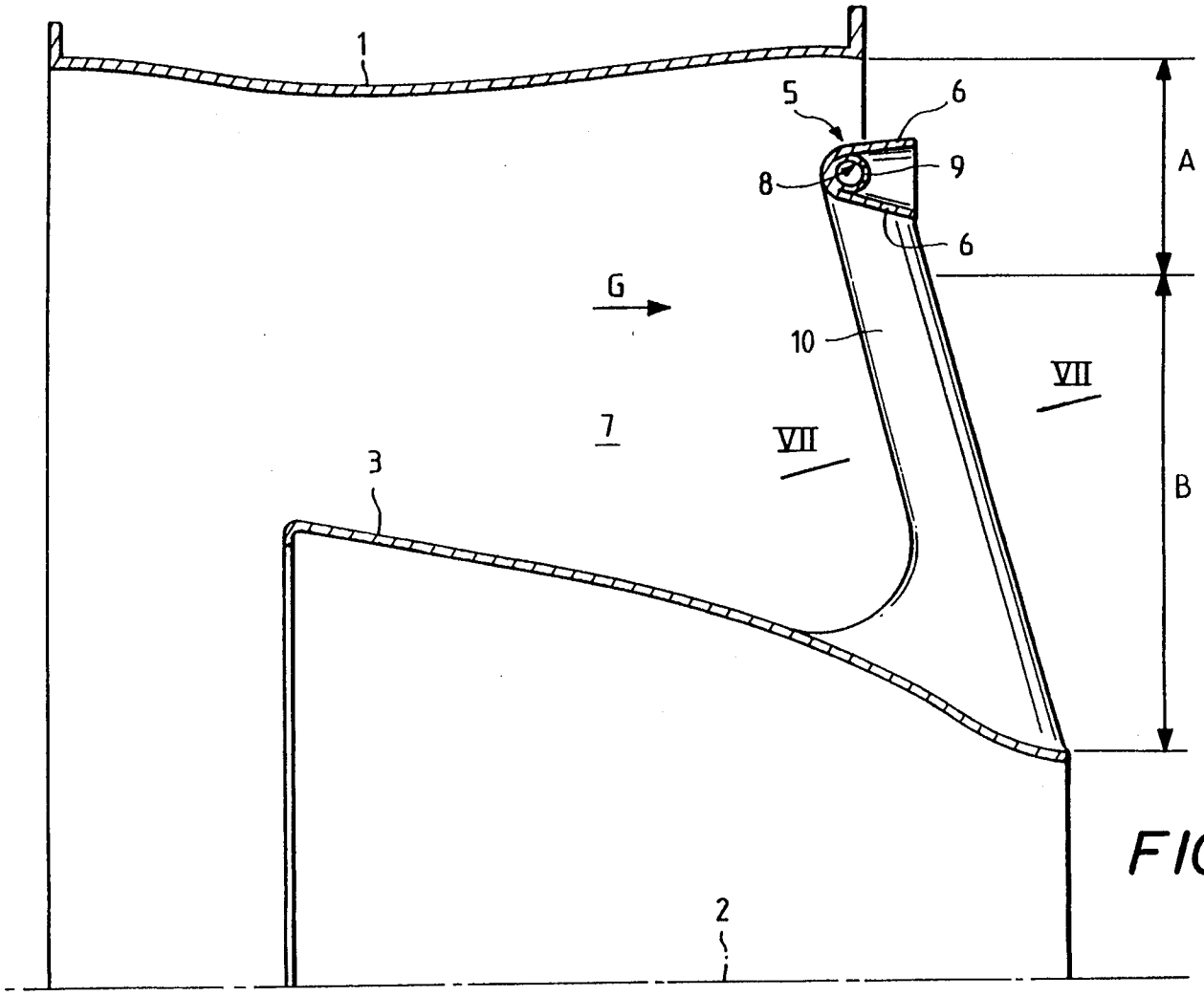
FIG. 6 is a cross-sectional view taken along line VI—VI in FIG. 1.

As illustrated in FIGS. 2 and 6, the use of composite materials allows the use of materials having different thermal characteristics. In Zone A, which is the most remote from the central axis 2 and in which is located the outer casing 1, the composite material may have a thermal resistance which is less than the thermal resistance of the composite material used in Zone B, which is located radially inwardly towards the central axis 2 and in which is located at the inner casing 3. The radial temperature gradient for a particular application of the afterburner structure can be computed which will enable the specific composite material to be used for the proper radial location to accommodate the temperatures without reducing the strength.

The shapes of the connecting arms 4 and the annular flameholder ring 5 permit flame stabilization, while at the same time, provide a complementary and evenly distributed injection.

The integral design of the afterburner structure according to this invention enables the multiple fastening systems and elements of the known afterburner structures to be completely eliminated. This reduces the mass and bulk of the afterburner, and enables the reduction of disturbances in the gas flow caused by the connecting and secondary support arms and a commensurate decrease in pressure losses which results in an increase in the overall efficiency of the gas turbine engine. The cross-sectional configurations of the connecting arms 4, the secondary support arms 10 and the annular flameholder ring 5 further improve the flow of gases through the afterburner. Furthermore, the use of composite materials allows the selection of specific materials having excellent thermal resistance at high temperatures, such as ceramic composites which can withstand temperatures in excess of 1,500° C. The higher temperatures also result in higher efficiencies of gas turbine engine operation.

Although the secondary support arms 10 are shown as having a generally oval cross-sectional configuration, it is to be understood that they may also have a generally "V"-shaped cross-section and include fuel conduits similar to the connecting arms 4. Furthermore, the secondary support arms 10 may also define holes similar to fuel injecting holes 14 to enable fuel to be injected through the support arms thereby improving the distribution of fuel in the afterburner structure.

The foregoing description is provided for illustrative purposes only and should not be construed as in any way limiting this invention, the scope of which is defined solely by the appended claims.

We claim:

1. An integral, one-piece afterburner structure for a turbojet engine comprising:

a) an outer casing portion formed of composite material and formed as a first body of revolution about a central axis;

b) an inner casing portion formed of composite material and formed as a second body of revolution about the central axis;

c) plurality of connecting arms formed of composite material integral with and extending between the inner and outer casing portions so as to connect the inner and outer casing portions together as an integral unit, at least one of the connecting arms defining a main fuel conduit;

d) a plurality of secondary support arms formed of composite material integral with one of the outer and inner casing portion and extending therefrom; and, e) at least one annular flameholder ring formed of composite material so as to be integral with the plurality of secondary support arms and defining a secondary fuel conduit in communication with the main fuel conduit.

2. The integral, one-piece afterburner structure of claim 1 wherein the outer casing portion is formed of a first composite material and the inner casing portion is formed of a second composite material having a higher thermal resistance than the first composite material whereby the inner casing portion is able to withstand higher temperatures than the outer casing portion.

3. The integral, one-piece afterburner structure of claim 1 wherein each of the connecting arms has a generally "V"-shaped cross-sectional configuration.

4. The integral, one-piece afterburner structure of claim 1 wherein the connecting arms extend substantially radially with respect to the central axis.

5. The integral, one-piece afterburner structure of claim 1 wherein the at least one annular flameholder ring has a substantially "U"-shaped cross-sectional configuration.

6. The integral, one-piece afterburner structure of claim 1 further comprising a plurality of fuel injecting holes defined by the at least one connecting arm such that the fuel injecting holes are in communication with the main fuel conduit.

7. The integral, one-piece afterburner structure of claim I further comprising a plurality of secondary fuel injecting holes defined by the at least one annular flameholder ring in communication with the secondary fuel conduit.

8. The integral, one-piece afterburner structure of claim 1 wherein the secondary support arms extend outwardly from the inner casing portion.

* * * * *